US005809972A

United States Patent [19]

Grant

[11] Patent Number: 5,809,972

[45] Date of Patent: Sep. 22, 1998

[54] VENTURI-ASSISTED FUEL INJECTION CARBURETOR SYSTEM

[76] Inventor: Barry Grant, Rte. 1, Box 1900, Dashlonega, Ga. 30533

[21] Appl. No.: 899,342

[22] Filed: Jul. 23, 1997

Related U.S. Application Data

[60] Provisional application No. 60/000,149, Jun. 22, 1995.

Related U.S. Application Data

[63] Continuation-in-part of Ser. No. 668,219, Jun. 21, 1996, abandoned.

[51] Int. Cl.[6] ..... F02M 51/02

[52] U.S. Cl. ..... 123/478; 123/472; 261/23.2; 261/DIG. 82

[58] Field of Search ..... 123/438, 445, 123/470, 472, 478; 261/23.2, DIG. 82

[56] References Cited

U.S. PATENT DOCUMENTS

| | | | |
|---|---|---|---|
| 3,868,936 | 3/1975 | Rivere | 123/445 |
| 4,204,507 | 5/1980 | Casey et al. | 123/470 |
| 4,354,470 | 10/1982 | Miyaki et al. | 123/472 |
| 4,430,275 | 2/1984 | Horton | 261/23.2 |
| 4,494,511 | 1/1985 | Ito et al. | 123/470 X |

*Primary Examiner*—Tony M. Argenbright

*Attorney, Agent, or Firm*—Thomas, Kayden, Horstemeyer & Risley

[57] ABSTRACT

Fuel at a regulated pressure passes from a fuel to tank one or more fuel injectors disposed in fuel injector housings formed in mounting blocks that are mounted to the sides of a carburetor center section. Each injector is in fluid communication with a booster venturi ring that is suspended in each carburetor barrel. The injectors intermittently deliver high pressure pulses of fuel to the booster venturi rings which disperse the fuel into the airstream. The high velocity of the airstream passing through the suspended booster venturi ring decreases the pressure of the airstream, resulting in greater atomization of the injected fuel.

13 Claims, 3 Drawing Sheets

VENTURI-ASSISTED FUEL INJECTION CARBURETOR SYSTEM

CROSS REFERENCE TO RELATED APPLICATION

This is a continuation-in part of U.S. patent application Ser. No. 08/668,219, filed Jun. 21, 1996, now abandoned, which claims priority to provisional application Serial No. 60/000,149, filed Jun. 22, 1995.

FIELD OF THE INVENTION

This invention relates generally to a fuel supply system for an internal combustion engine. More particularly, the invention relates to a fuel injection system which utilizes a fuel injected carburetor having a plurality of venturi passages.

BACKGROUND OF THE INVENTION

The technology for high performance combustion engines has evolved over the years, from vacuum induced fuel flow through venturi passages in a carburetor, to sophisticated controls for regulating the fuel as it flows to the carburetor, and later to direct injection of the fuel into the airstream leading to the engine. Carburetion systems provide the advantage of being self-regulating, in that higher numbers of revolutions per minute (rpm's) of the engine induce more air to flow through the carburetor, with the passage of this air flow through the venturi passage lowering the pressure in the passage to atomize the fuel induced into the carburetor. In recent years, carburetion systems have been replaced by fuel injection systems using electronically controlled fuel injectors. When fuel injectors are utilized, there is usually more accuracy in controlling the delivery of fuel into the airstream leading to the cylinders of the engine over a wider range of rpm's of the engine. The velocity of the airstream has little effect on the amount of fuel admitted to the airstream by a fuel injector because of the high pressure of the fuel (typically 15–60 psi) as it passes through the injector toward the airstream.

With high performance combustion engines, it is important that large amounts of fuel be accurately injected into and atomized within the airstream moving to the engine cylinders. With better atomization, more of the fuel is combusted and less fuel is wasted. However, the accuracy of fuel metering achieved through use of fuel injectors does not necessarily ensure that the desired degree of atomization is achieved. Accordingly, the high performance engine which receives its fuel from fuel injectors may have a higher brake specific fuel consumption than conventional venturi passage carburetors. Thus, it can be appreciated that a fuel system combining the high atomization of a carburetor and the precise fuel metering of fuel injectors would be desirable.

SUMMARY OF THE INVENTION

The present invention combines high fuel atomization with precise fuel metering. Briefly described, the present invention comprises a venturi-assisted fuel injection carburetor system for an internal combustion engine, whereby fuel is injected by an electronically controlled fuel injector into a carburetor having a plurality of barrels that form venturi passages. As is conventional in the art, the venturi passages lead to an intake manifold of a combustion engine. In a preferred embodiment, the structure utilizes a conventional carburetor center section having a two or four barrel structure. Each barrel of the structure includes an inwardly protruding venturi wall constriction and a suspended booster venturi ring which disperses the high pressure injected fuel into the center of the airstream.

In a preferred embodiment of the invention, individual fuel injectors are used to feed each venturi ring of each barrel of a multi-barrel carburetor center section. The fuel injectors are operated in sequence by a control system, so that the fuel pulses are time spaced sequentially among the venturi rings in synchronization with observed engine operating conditions.

Fuel injector mounting blocks are provided to facilitate mounting of each fuel injector to the carburetor center section. Typically, each mounting block includes a mounting surface configured to engage mounting surfaces formed on the sides of the carburetor center section, and at least one fuel injector housing that is configured to house a fuel injector. Each mounting block further includes fluid conduits for delivering fuel from the fuel injector to the center section. Typically, each conduit extends from a single injector housing to one of several fuel conduits formed in the carburetor center section which each leads to a particular booster venturi ring. Although alternative configurations are possible, the fuel injected carburetor typically includes two fuel injector mounting blocks, each having one or more fuel injector housings. A single fuel injector is disposed in each housing with its injection nozzle directed toward the fluid conduit extending from the housing. Where there is an equal number of fuel injectors and carburetor barrels, each fuel injector will deliver fuel to a single venturi booster ring, and therefore a single carburetor barrel.

Further included in each fuel injector mounting block is a fuel plenum. In one aspect of the invention, the fuel plenum is formed as a cylindrical bore that is in fluid communication with each fuel injector housed within the mounting block. Each fuel plenum is supplied with fuel from a fuel regulator and functions as a fuel supply for each injector.

So described, the invention therefore breeds two technologies of fuel supply to a combustion engine. The fuel injectors meter a correct amount of fuel at high pressure to the suspended booster venturi ring over the entire operating range of the engine, so that accurate control can be maintained over the fuel supply at all rpm's of the engine. At the same time, the two venturi wall constrictions, one in the wall of the carburetor barrel and the other in the venturi ring suspended in the barrel, cause the airstream carrying the injected fuel to increase in velocity and decrease in pressure, resulting in more complete atomization of the injected fuel than would occur if the injected fuel were fed into the airstream without first passing through a venturi wall constriction.

The fuel injectors typically are controlled by a control system including a computer which senses the manifold absolute pressure, the throttle position, and the engine rpm so as to calculate the amount of fuel required during the various operating conditions of the engine. The computer can be controlled by various algorithms that are suitable for operating the combustion engine in predetermined conditions. The computer generates an electronic pulse for each injector, with the injector being opened and remaining open for the duration of the pulse. In order to change the volume of fuel entering over a time span, the duration of the pulse is modulated, with longer pulses opening the valve for longer periods of time and therefore supplying more fuel to the engine. If desired, other conditions can be sensed by the computer and used for regulating the pulse duration generated by the computer, such as water temperature of the engine, outside air temperature, humidity and oxygen.

In addition to providing improved performance, the system of the present invention allows the user to convert a conventional carburetion system to a fuel injected system with little modification to the carburetor. To make such a conversion, the fuel bowls and metering blocks of the carburetor are simply removed and are replaced with fuel injector mounting blocks which each contain one or more fuel injectors. Since the fuel conduits of the carburetor center section are utilized for delivery of the injected fuel to the carburetor barrels, no further carburetor alteration is necessary. Once the carburetor has been modified, the control system including sensing devices and a computer is mechanically and electrically connected to the engine, thereby completing the conversion.

Thus, it is an object of this invention to provide an improved fuel injection carburetor system for a combustion engine, whereby fuel is injected by an electronically controlled fuel injector into the airstream of carburetor barrels having venturi wall constrictions formed thereon to achieve greater atomization of the injected fuel.

Another object of this invention is to provide a venturi-assisted fuel injection carburetor system for a combustion engine, whereby control of the fuel that is injected into the airstream can be maintained more accurately over the full range of operation of the engine.

A further object of this invention is to provide a fuel supply system which allows the user to convert a conventional carburetion system into a fuel injection carburetor system with little modification to the carburetor.

Other objects, features and advantages of this invention will become apparent upon reading the following specification, when taken in conjunction with the accompanying drawings.

DETAILED DESCRIPTION

Figure 1:
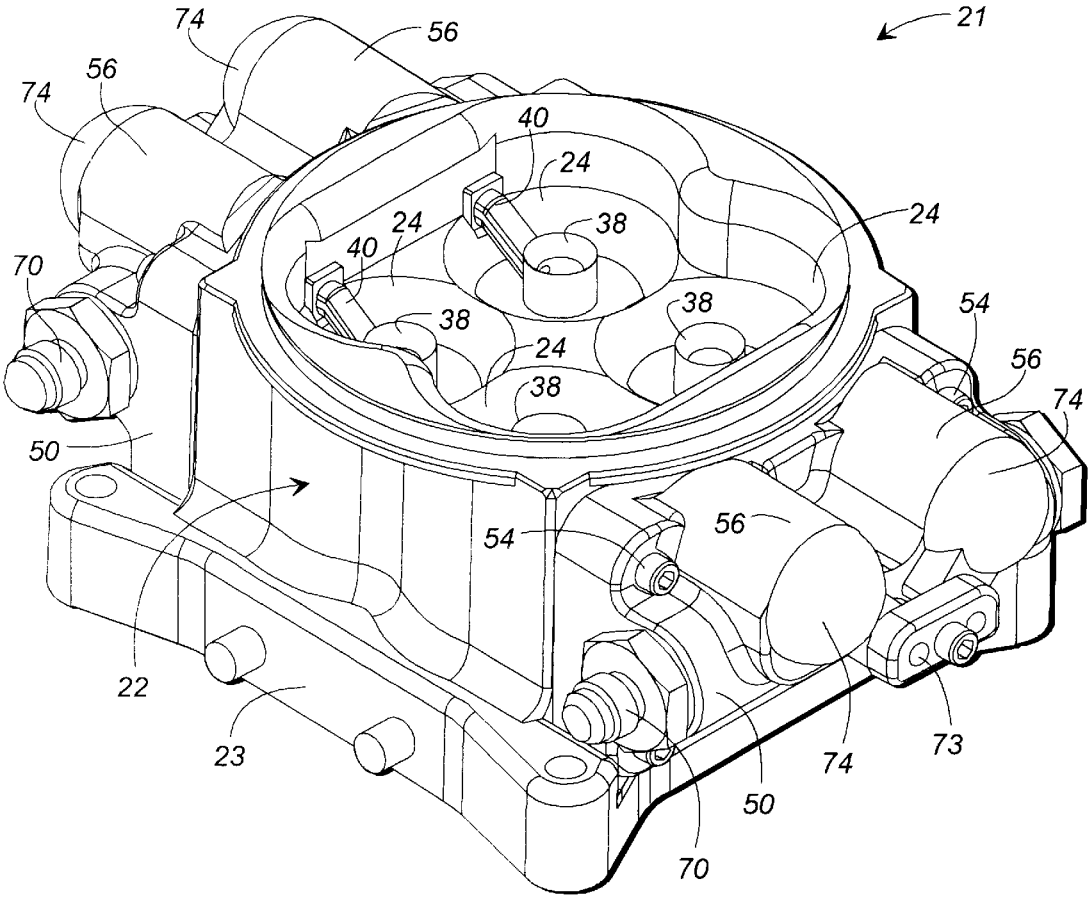
FIG. 1 is a perspective illustration of the carburetor section of the venturi-assisted fuel injection carburetor system of the present invention.

Referring now in more detail to the drawings, in which like numerals indicate like parts throughout the several views, FIG. 1 illustrates a carburetor section 21 of the venturi-assisted fuel injection carburetor system. The carburetor section generally includes a carburetor center section 22 having a plurality of barrels 24 provided therein and a base plate 23 that is mounted to the base of the center section. Although shown as being unitarily formed with the center section 22, it is to be understood that the base plate could alternatively be formed separately. As depicted in schematic form in FIG. 2, the fuel injection carburetor system 10, receives fuel from a fuel tank 12 and delivers the fuel to the carburetor section 21 which delivers it to a combustion engine 14. More specifically, a fuel pump 16 delivers the fuel from the fuel tank 12 to a fuel pressure regulator 18 which then delivers the fuel to one or more fuel plenums 68 which are in fluid communication with the fuel injectors 20. Excess fuel is delivered from the plenums back to the fuel tank via a fuel return line 17. Typically, when a multiple barrel carburetor center section is used, there will be one fuel injector 20 for each barrel of the carburetor. In FIG. 1, however, only one barrel of the carburetor shown for purposes of illustration. The pressure of the fuel held in the plenum 68 is regulated by the fuel pressure regulator 18 so as to be is at a constant pressure, typically from 15 to 25 psi. Where higher fuel demand must be satisfied, however, the fuel could be pressurized to a higher pressure.

Figure 2:
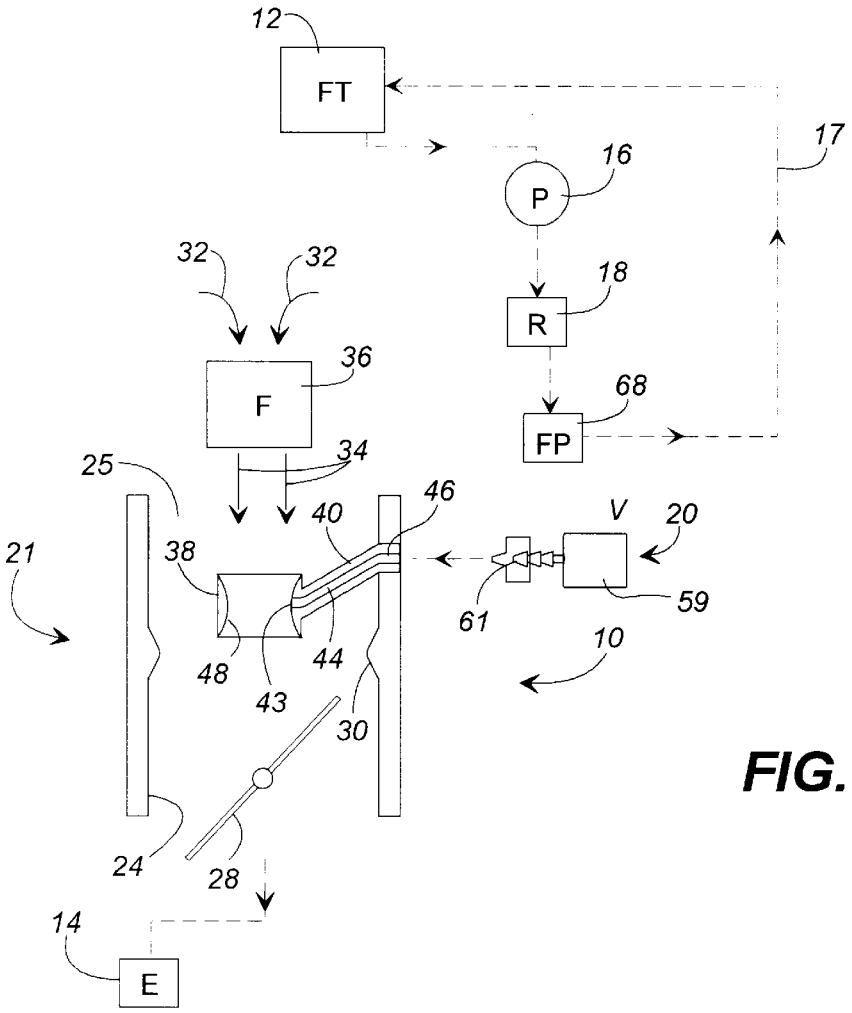
FIG. 2 is a schematic illustration of the air and fuel flow of the fuel injection system.
Figure 5:
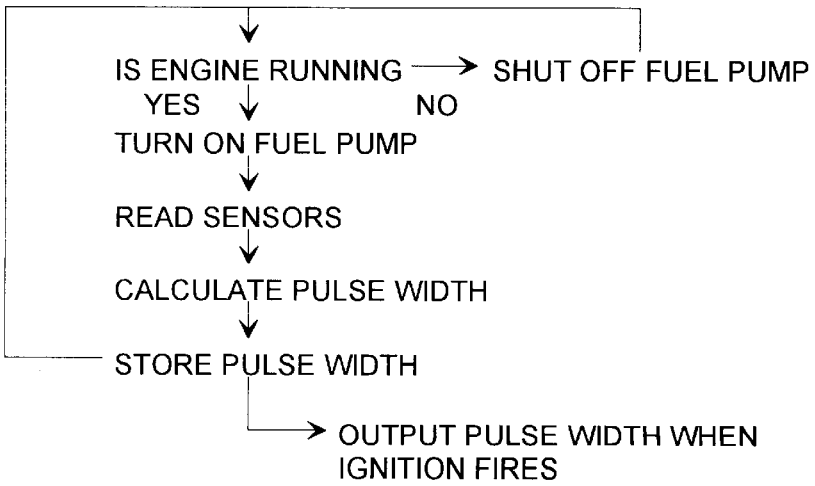
FIG. 5 is a schematic illustration of the control of the fuel injectors.
Figure 4:
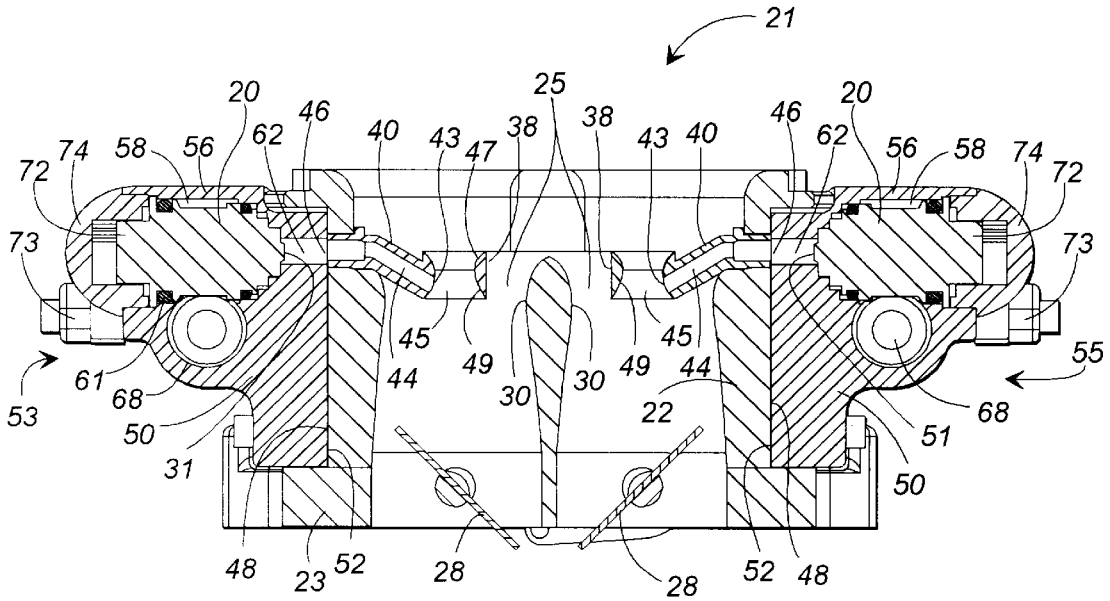
FIG. 4 is a side cross-sectional view of the carburetor section taken along line A—A in FIG. 3.

The carburetor center section 22 can include one, two, four, or more barrels 24. Each barrel forms a venturi passage 25 that communicates with the cylinders of the combustion engine 14 through throttle or butterfly valves 28. The throttle valves 28 typically are pivotally mounted in each barrel, downstream of the venturi passage as shown in FIGS. 2 and 4. The venturi passages 25 each include a venturi wall constriction 30 which is an annular inwardly protruding constriction of a cross-sectional shape well known in the art. In operation, air moves in the direction indicated by arrows 32 and 34, passing through an air filter 36 (if provided), and then through the venturi passage 25. As the air passes the venturi wall constriction 30, the velocity of the air is increased and the pressure of the air is decreased. This decrease in air pressure forms a zone of low pressure useful in atomizing the fuel passing through each barrel.

As illustrated in FIG. 4, a booster venturi ring 38 is suspended coaxially in each venturi passage 25 by a fuel supply tube 40. The fuel supply tube 40 is mounted to the sidewall of the carburetor center section 22 in a conventional manner with its internal fuel conduit 44 in fluid communication with a fuel outlet 43 positioned in the venturi ring 38 and a fuel inlet port 46 of the carburetor center section. The inner surface 48 of the suspended booster venturi ring 38 forms a booster venturi passage 45 having an inlet opening 47 and an outlet opening 49. Shaped similarly to the venturi passages 25 of each carburetor barrel, air passing through the booster venturi passages is accelerated, causing the pressure of the air to decrease.

In a preferred embodiment, the suspended booster venturi ring 38 is positioned with the outlet opening 49 of the booster venturi passage placed slightly upstream of the venturi wall constriction 30 formed by the venturi passage of each carburetor barrel, usually between twenty and thirty thousandths of one inch upstream. By placing outlet opening 49 of the booster venturi ring within this range of distance from the venturi wall constriction 30 of the carburetor barrel, the air passing through the booster venturi ring will exit the ring in the zone of low pressure created by the venturi wall constriction 30. Thus, the booster venturi ring 38 generates an even lower pressure in the air stream than either the booster venturi ring 38 or the venturi wall constriction 30 would by themselves. As is known in the art, this lower pressure results in a more complete atomization of the fuel in the airstream.

Figure 3:
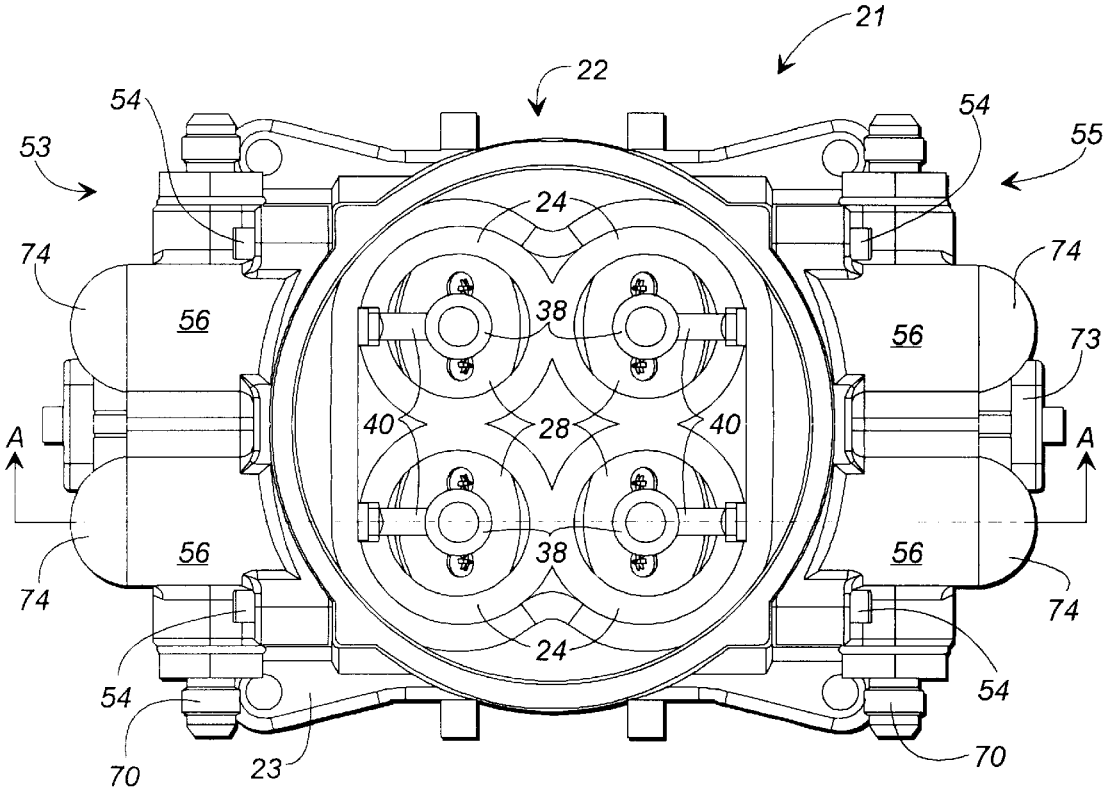
FIG. 3 is a top view of the carburetor section of FIG. 1.

Shown most clearly in FIGS. 1 and 3–4, the carburetor center section 22 typically has four barrels 24. Formed on opposite sides 53 and 55 of the center section 22 are substantially planar mounting surfaces 48. As shown in FIG. 4, two mounting blocks 50 typically are provided, each mounting block having a substantially planar mounting surface 52 configured to engage one of the mounting surfaces 48 of the carburetor center section so that the mounting blocks can be attached to the sides of the center section with fasteners such as screws or bolts 54. Although not depicted, a gasket or similar spacer will be positioned between each mounting block and the center section to ensure an air tight fit. In addition, although depicted as being substantially planar, the mounting surfaces of the mounting blocks will be configured so as to conform to the mounting surfaces of the particular carburetor center section used.

Preferably, the mounting blocks 50 are formed from a solid billet of material such as aluminum, steel, or like metal. Formed in each mounting block 50 is at least one fuel injector housing 56. Where the center section has four barrels, each mounting block typically will be provided with two such housings so that one injector is used for each barrel. As shown in FIG. 4, each housing generally comprises cylindrical opening 58 integrally formed in the mounting block. In one aspect of the invention, this opening is formed as a stepped cylinder as shown in FIG. 4. However, it will be appreciated that the size and shape of the opening will vary depending upon the type of fuel injector that is used in the system. Each injector 20 is of conventional design and includes a solenoid 59 that reciprocates its injection nozzle 61 in response to electrical impulse to eject predetermined amounts of fuel therefrom. Typically, each fuel injector will have an O-ring 61 or similar gasket which tightly seals the injector within its housing. Examples of fuel injectors suitable for high performance applications such as that of the present invention are Holley injector 250R51AAK, Sagem injector D3190CB, and Delphi injector 17084865. Although described as utilizing one fuel injector for each barrel, it is to be noted that more than one injector can be used to deliver fuel to each barrel, or one injector can be used to deliver fuel to more than one barrel.

Each cylindrical opening 58 provided in the injector housing connects to a fuel conduit 62 formed in the mounting block. As depicted in FIG. 4, each fuel conduit is in fluid communication with both the cylindrical opening (and therefore with the fuel injector) and the inlet port 46 of the fuel conduit 44 extending through the fuel supply tube 40 of the carburetor center section. When properly seated in its opening 58, each injector 20 is oriented with its injection nozzle 61 directed toward the fuel conduit 62 connected to the opening and a connector end 72 extending beyond its housing 56 so that an electrical connector (not shown) formed in the injector can be electrically connected with the control system. In one aspect of the invention, the connectors of adjacent injectors will be housed in a single connector housing 73, however it is to be appreciated that each connector can remain separate. In a preferred embodiment, each injector is oriented such that the central longitudinal axis of each injector lies in a plane that is perpendicular to the central longitudinal axis of each of the carburetor barrels (FIGS. 3–4). To protect the connector end 72 of each fuel injector from dirt, debris, and the like, end caps 74 can be connected to the fuel injector housings 56 as indicated in FIGS. 1 and 3–4. Although depicted as separate caps, it will be understood that the size and configuration of the caps will vary depending upon the particular fuel injectors used.

Extending within each mounting block perpendicular to longitudinal axis of the fuel injectors 20 is a fuel plenum 68. Typically, this fuel plenum takes the form of a cylindrical bore provided with openings (not shown) through which the plenum fluidly communicates with each fuel injector mounted in the mounting block. In operation, each plenum 68 receives fuel from the fuel pressure regulator 18 through an inlet port 70. The fuel received from the regulator is typically between 15–25 psi. Since the fuel injectors 20 operate under a substantially constant pressure head, and since the duration of fuel injector nozzle 61 actuation is predetermined, a predictable volume of fuel can be injected upon each actuation of the injector 20 with the change in internal pressure within the airstream having little, if any, effect on the flow of fuel into the engine.

The control system typically opens the injector valves in sequence, so as to assist in providing a uniform amount of fuel to each barrel of the carburetor center section. When a four barrel carburetor is used, the fuel injectors are actuated in a cross over pattern to enhance distribution of the fuel to the airstream flowing to the engine. The sequential crossover actuation of the injector valves assures that, for a given amount of the airstream moving toward the engine 14, the volume of fuel is substantially uniformly injected into the airstream, so that no slugs or dead spots are formed in the fuel and air sure. When more fuel is required, the valves simply stay open longer on each valve cycle.

In operation, the volume and velocity of the airstream is controlled by the throttle valves 28 which are manipulated by a lever (not shown) as is conventional in the art. The position of the throttle valve is sensed by the computer with a sensing device such as a rheostat (not shown) that provides an indication of the amount of fuel required by the user. Pressure sensors will also be used as desired to provide further engine operating condition information to the computer so that the computer can, with an appropriate algorithm, control the signals provided to the fuel injectors 20. Similarly, an engine speed indicator will be used to provide the computer with further control parameter information. Accordingly, the control system can include various sensing means to signal the computer control means to precisely control the duration and sequence of fuel injector actuation for optimum results.

In accordance with the present invention as described above, the engine operator can convert a conventional carburetion system into a fuel injection system without major modification of the carburetor. To effect such a conversion, the user removes the float bowls and metering blocks from the sides of the carburetor center section. Next, the fuel injector mounting blocks 50 are attached to the center section, in place of the removed float blows and metering blocks, on the sides of the center section. To complete the conversion, the desired sensing devices are installed and all electrical connections made between the sensing devices, computer, fuel injectors, and power source, so that the system is prepared for use as a fuel injection carburetor system.

While preferred embodiments of the invention have been disclosed in detail in the foregoing description and drawings, it will be understood by those skilled in the art that variations and modifications thereof can be made without departing from the spirit and scope of the invention as set forth in the following claims.

I claim:

1. A venturi-assisted fuel injection carburetor system for a combustion engine, said system comprising:

a carburetor center section having a plurality of barrels extending therethrough, each barrel forming a venturi passage having a wall constriction therein for forming a zone of low pressure in said venturi passage in response to movement of air through said venturi passage, said center section further having mounting surfaces formed on sides of said center section;

a plurality of throttle valves, one throttle valve positioned in each barrel downstream from each wall constriction;

fuel injector mounting blocks, each fuel injector mounting block having at least one fuel injector housing and a mounting surface, one mounting block being mounted to each of said mounting surfaces of said center section;

a plurality of fuel injectors, each fuel injector being mounted in a fuel injector housing of one of said fuel injector mounting blocks, and a plurality of fuel conduits provided in said mounting blocks and said center section, each fuel conduit extending from one fuel injector, through its mounting block, and through said center section to one of said venturi passages such that each fuel injector is in fluid communication with one of said venturi passages;

wherein said fuel injectors can be used to intermittently and sequentially inject fuel into said venturi passages via said conduits with said fuel being atomized by the zones of low pressure formed in said venturi passages so that said atomized fuel can be passed into the engine for combustion.

2. The venturi-assisted fuel injection carburetor system of claim 1, wherein said mounting surfaces of said carburetor center section are formed on opposite sides of said center section such that said fuel injector mounting blocks are mounted on opposite sides of said center section.

3. The venturi-assisted fuel injection carburetor system of claim 2, wherein each of said fuel injectors is oriented in said mounting blocks such that a central longitudinal axis of each fuel injector lies in a plane that is perpendicular to a central longitudinal axis of each carburetor barrel.

4. The venturi-assisted fuel injection carburetor system of claim 1, wherein each fuel injector mounting block further includes a fuel plenum in fluid communication with each fuel injector mounted in said mounting block.

5. The venturi-assisted fuel injection carburetor system of claim 4, wherein each fuel plenum comprises a cylindrical bore formed in each mounting block, each plenum being oriented perpendicularly to a central longitudinal axis of each fuel injector mounted in said mounting block.

6. The venturi-assisted fuel injection carburetor system of claim 1, wherein each carburetor barrel further includes a suspended booster venturi ring, each booster venturi ring having a booster venturi passage extending therethrough that includes a fuel outlet, each booster venturi ring being attached to a fuel supply tube that is in fluid communication with said fuel outlet of said venturi ring and with one of said fuel conduits formed in one of said mounting blocks, such that when fuel is ejected from one of said fuel injectors, the fuel passes through one of said fuel supply tubes, to be ejected from a fuel outlet of one of said booster venturi rings and into said zone of low pressure formed in said carburetor barrel.

7. The venturi-assisted fuel injection carburetor system of claim 6, wherein each booster venturi passage has an inlet opening and an outlet opening, and wherein each booster venturi ring is suspended in its barrel with the outlet opening of said booster venturi passage positioned adjacent said wall constriction of said venturi passage formed in said barrel.

8. The venturi-assisted fuel injection carburetor system of claim 1, further comprising sensing means for sensing engine operating conditions to determine the proper time and duration for actuating said fuel injectors, and control means for actuating said fuel injectors in response to the engine operating conditions sensed by said sensing means.

9. A carburetor conversion system for converting a conventional carburetor center section into a fuel injection carburetor system, the center section having a plurality of barrels that form venturi passages, and mounting surfaces formed on opposite sides of the center section, said fuel injection conversion system comprising:

fuel injector mounting blocks, each fuel injector mounting block having at least one fuel injector housing and having a mounting surface configured to engaging one of the mounting surfaces of the carburetor center section, each mounting block further having a fuel conduit extending from each injector housing and configured to connect with a fuel conduit formed in the center section that extends from the mounting surface of the center section to one of the carburetor barrels;

a plurality of fuel injectors each having an injection nozzle, one fuel injector mounted within each fuel injector housing of each mounting block with said nozzle being directed toward one of said fluid conduits of said mounting block such that each fuel injector is adapted for fluid communication with one carburetor barrel;

sensing means for sensing engine operating conditions to determine the proper timing and duration for actuation of said fuel injectors; and control means for actuating said fuel injectors in response to the engine operating conditions sensed by said sensing means;

wherein said fuel injectors are intermittently and sequentially actuated by said control means to inject fuel and air into the carburetor barrels so that the fuel can be atomized by the venturi passages before being passed into the engine for combustion.

10. The carburetor conversion system of claim 9, wherein each of said fuel injectors is oriented in said mounting blocks such that a central longitudinal axis of each fuel injector lies in a plane that is adapted to be perpendicular to a central longitudinal axis of each carburetor barrel.

11. The carburetor conversion system of claim 9, wherein each fuel injector mounting block further includes a fuel plenum in fluid communication with each fuel injector mounted in said mounting block.

12. The carburetor converstion system of claim 11, wherein each fuel plenum comprises a cylindrical bore formed in each mounting block, each plenum being oriented perpendicularly to a central longitudinal axis of each fuel injector mounted in said mounting block.

13. A method for converting a carburetion system of a combustion engine into a fuel injection system, said method comprising the steps of:

providing a conventional carburetor center section having a plurality of carburetor barrels that form venturi passages, mounting surfaces formed on opposite sides of the center section, and fuel conduits that extend from the mounting surfaces to the barrels;

providing at least one fuel injector mounting block having at least one fuel injector housing, a mounting surface, and a fuel conduit extending from each injector housing to the mounting surface of the block;

mounting a fuel injector in each fuel injector housing with the fuel injector directed towards the fuel conduit so as to be in fluid communication therewith;

mounting the fuel injection mounting block to the carburetor center section with the mounting surface of each mounting block in engagement with one of the mounting surfaces of the center section and the fuel conduit of the mounting block in fluid communication with one of the fuel conduits of the carburetor center section;

connecting the fuel injector to control means for intermittently actuating the fuel injector; and connecting the control means to sensing means for sensing engine operation conditions to determine the proper timing and duration of actuation of the fuel injector;

wherein the fuel injector is intermittently actuated by the control means in response to the engine operation conditions sensed by the sensing means to inject fuel and air into the carburetor barrels so that the fuel can be atomized by the venturi passages before being passed into the engine for combustion.

* * * * *